US010964134B2

(12) United States Patent
Frisch et al.

(10) Patent No.: US 10,964,134 B2
(45) Date of Patent: Mar. 30, 2021

(54) CLOUD-BASED ON-DEMAND VEHICLE DIAGNOSTIC SYSTEMS

(71) Applicant: Hunter Engineering Company, Bridgeton, MO (US)

(72) Inventors: Ryan J. Frisch, St. Louis, MO (US); Mark E. Pinson, St. Louis, MO (US); Nicholas J. Colarelli, III, Frontenac, MO (US)

(73) Assignee: HUNTER ENGINEERING COMPANY, St. Louis, MO (US)

( * ) Notice: Subject to any disclaimer, the term of this patent is extended or adjusted under 35 U.S.C. 154(b) by 65 days.

(21) Appl. No.: 16/428,253

(22) Filed: May 31, 2019

(65) Prior Publication Data

US 2019/0371091 A1 Dec. 5, 2019

Related U.S. Application Data

(60) Provisional application No. 62/680,806, filed on Jun. 5, 2018.

(51) Int. Cl.
*G07C 5/08* (2006.01)
*G07C 5/00* (2006.01)

(52) U.S. Cl.
CPC ..... *G07C 5/0808* (2013.01); *G07C 5/008* (2013.01)

(58) Field of Classification Search
CPC ..... G07C 5/0808; G07C 5/008; G07C 5/006; G07C 5/0816; G07C 2205/02; G06N 20/00; G06N 5/04; G06F 17/00; G06F 11/22; G06Q 30/02; G06Q 30/06; G06Q 30/0283
See application file for complete search history.

(56) References Cited

U.S. PATENT DOCUMENTS 8,688,313 B2 4/2014 Margol et al.
9,684,500 B2 6/2017 Margol et al.
2011/0106374 A1* 5/2011 Margol ..... G07C 5/008 701/31.4
2014/0249696 A1 9/2014 Margol et al.
2016/0335816 A1* 11/2016 Thoppae ..... H04L 67/42
(Continued)

FOREIGN PATENT DOCUMENTS

WO 2012087729 A2 6/2012

*Primary Examiner* — Anne Marie Antonucci
*Assistant Examiner* — Andrew J Cromer
(74) *Attorney, Agent, or Firm* — Sandberg Phoenix & von Gontard, P.C.

(57) ABSTRACT

A vehicle service system for interaction with the on-board electronic systems of a vehicle utilizing a cloud-based vehicle diagnostic system which is configured on-demand for the vehicle undergoing a service procedure. The vehicle service system includes a local processing system in communication with the vehicle and with a cloud-based vehicle diagnostic application service configured to establish an on-demand virtual processing system running a vehicle-specific diagnostic software application. The vehicle-specific diagnostic software application communicates with the vehicle undergoing service to present a service technician with diagnostic results within a graphical user interface of the local processing system. Upon completion of the vehicle service, the remote cloud-based vehicle diagnostic application service terminates the virtual processing system and vehicle-specific diagnostic software application, freeing cloud-based resources for subsequent uses.

21 Claims, 4 Drawing Sheets

(56) References Cited

U.S. PATENT DOCUMENTS

| | | | | |
|---|---|---|---|---|
| 2017/0083874 | A1* | 3/2017 | Hoover | G06Q 10/06375 |
| 2017/0277527 | A1 | 9/2017 | Margol et al. | |
| 2018/0286146 | A1 | 10/2018 | Liu et al. | |

* cited by examiner

CLOUD-BASED ON-DEMAND VEHICLE DIAGNOSTIC SYSTEMS

CROSS-REFERENCE TO RELATED APPLICATIONS

The present application is related to, and claims priority from, co-pending U.S. Provisional Patent Application Ser. No. 62/680,806 filed on Jun. 5, 2018, which is herein incorporated by reference.

STATEMENT REGARDING FEDERALLY SPONSORED RESEARCH

Not Applicable.

BACKGROUND OF THE INVENTION

The present application is related to the implementation of vehicle-specific diagnostic and system reset procedures typically carried out by vehicle-specific service devices operatively coupled to the vehicle electronic control modules during a vehicle service process, and in particular, to a method and system in which multiple vehicle-specific service devices are replaced by vehicle-specific software applications residing in, and operating from, cloud-based virtual computers, enabling a service technician to select, communicate with, and couple a vehicle to an appropriate virtual vehicle-specific service device at the time of vehicle service.

As vehicles have become increasingly computerized, many diagnostic and repair procedures require a service technician to interface with the vehicle onboard computer systems or electronic control units (ECUs) via a standardized data connection commonly referred to as an OBD-II connection. For example, proper operation of many advanced driver assistance (ADAS) components on modern vehicles, such as adaptive cruise control, lane departure warning systems, collision avoidance systems, and blind spot monitoring systems must be evaluated prior to performing mechanical adjustments on a vehicle, as well as after repair or replacement of damaged or worn vehicle components. Using a generic diagnostic device or scan tool, a technician connects to the OBD-II connection and reads out various fault codes from the onboard computer systems or ECUs during a vehicle service. In some cases, commands that conduct a calibration or other service procedure are relayed to the vehicle using the same device and connection. As vehicle complexity has increased, vehicle manufacturers have incorporated increased functionality in the onboard computer systems and ECUs, often requiring vehicle-specific or manufacturer-specific diagnostic devices or scan tools to access. (FIG. 1). These vehicle- and manufacturer-specific diagnostic devices or scan tools can be expensive, and are required in order to perform some service procedures on newer vehicles, representing a significant expenditure for independent automotive repair shops seeking to service a wide range of modern vehicle makes and models. In some cases, access to these specialized diagnostic devices or scan tools is restricted to manufacturer-approved dealerships or repair shops, leaving independent shops and do-it-yourself mechanics with few options to properly service a full range of desired vehicles.

Recent industry changes require that vehicle manufacturers make vehicle-required diagnostic and scan software applications available upon request, from an accessible software archive, enabling independent shops and do-it-yourself mechanics to service vehicles, as well as dealers seeking to service off-brand vehicles. These software applications, once downloaded via a network, are installed on a local personal computer (PC) and communicate with the electronic control modules of a vehicle undergoing service via a standardized interface. Typically, the local PC includes: (1) a monitor, or other physical means of displaying electronic graphic content; (2) one or more Human Interface Devices (HIDs), the most common of which are keyboards and mice, to provide a means to interact with the environment; (3) a network interface card (NIC) to connect to various network(s) providing data and applications; and (4) a transport bus, such as a universal serial bus (USB) to connect devices such as printers, diagnostic tools, or OBD port readers to the computing environment. Usage of the diagnostic and scan software applications, once downloaded, may be restricted to use during single vehicle service via an authentication or subscription service provided by the vehicle manufacturer. Different vehicle makes and or models require different software applications, thereby requiring a service technician to locate and install appropriate applications prior to performing a vehicle service or inspection. (FIG. 2).

While downloadable software applications enable more complete diagnostic and service of modern vehicles by a wide range of service providers, it has been found that installation of multiple downloadable software applications for different vehicle makes and models on a single PC often produces conflicts and problems. Hence, it often becomes necessary to remove the software applications following completion of a vehicle service in order to properly install different software applications required to service subsequent vehicles. Alternatively, a service shop may maintain a separate dedicated PC for each vehicle-specific software application. Failure to do so may lead to PC system crashes, failures, or improper vehicle diagnostics. Vehicle service technicians are generally not well skilled at performing software downloads, installations, and debugging procedures prior to or following each vehicle service.

Accordingly, it would be advantageous to provide vehicle service technicians with a means by which multiple vehicle-specific diagnostic and service software applications could be accessed on-demand, without requiring vehicle-specific hardware or multiple PCs, eliminating the need for the service technician to perform any local software installation and/or removal procedures as part of a vehicle service process.

BRIEF SUMMARY OF THE INVENTION

Briefly stated, the present application sets forth a vehicle service system for interaction with the on-board electronic systems of a wide range of vehicle makes and models, utilizing a cloud-based or virtualized vehicle diagnostic system configured on-demand for the particular vehicle undergoing a service procedure. The vehicle service system consists of a local PC or end-user terminal with a standardized interface or transport bus for operatively coupling to a diagnostic connection onboard a vehicle undergoing service. The standardized interface or transport bus provides a pathway for bi-directional communication between external devices and the various electronic control modules and sensors onboard the vehicle. A local processing system providing a suitable graphical user interface for a service technician is operatively coupled to the standardized interface for bi-directional communication with the vehicle. The local processing system is further connected, via a communications pathway such as a NIC and network, to a remote cloud-based vehicle diagnostic application service configured to establish a virtualization environment consisting of a virtual processing system running a vehicle-specific diagnostic software application in response to a request from the service technician input through the graphical user interface. Upon activation, the vehicle-specific diagnostic software application operating on the virtual processing system communicates with the vehicle undergoing service and the service technician through the communications pathway, local processing system graphical user interface, and bi-directional pathways of the standardized interface or transport bus. Options and diagnostic results available from the vehicle-specific diagnostic software application are presented to the service technician within the graphical user interface of the local PC or end-user terminal, enabling the service technician to conduct a vehicle-specific diagnostic, inspection, or service procedure as if the vehicle-specific diagnostic software application was present on the local PC or end-user terminal. Upon completion of the vehicle service, the remote cloud-based vehicle diagnostic application service terminates the virtual processing system and vehicle-specific diagnostic software application, freeing cloud-based resources for subsequent uses. Alternatively, the virtual processing system and vehicle-specific diagnostic software application may persist, awaiting a new connection by either the same user or a new user.

In a further embodiment, the cloud-based or virtualized vehicle diagnostic application service is configured with software instructions for user authentication, access control, subscription services, and payment processing as required for regulating access to multiple vehicle-specific diagnostic software applications. The vehicle diagnostic application service provides access to a database service storing installation packages for vehicle-specific diagnostic software applications, each of which is associated with at least one specific vehicle make or model. In response to an authenticated or approved request from a service technician, the cloud-based or virtualized vehicle diagnostic application service locates and retrieves an installation package for vehicle-specific diagnostic software application within the database which corresponds with a vehicle on which the service technician is currently performing a service or inspection procedure. The cloud-based or virtualized vehicle diagnostic application service is configured to establish a virtual processing system within the cloud environment, and to utilize the installation package to install the vehicle-specific diagnostic software application onto the non-persistent virtual processing system. With the vehicle-specific diagnostic software application installed on the virtual processing system, the service technician is provided with a graphical user interface on a local processing system or end-user terminal for communicating with the vehicle-specific diagnostic software application. Bi-directional communications between the vehicle and the vehicle-specific diagnostic software application are routed through the standardized interface or transport bus, local processing system, and intervening communications links or networks to the virtual processing system, enabling the vehicle-specific diagnostic software application to conduct appropriate vehicle service or inspection procedures.

In a further embodiment, the cloud-based vehicle diagnostic application service is configured to establish multiple independent virtual processing systems within the cloud-based or virtual processing environment, enabling multiple service technicians at various physical locations to simultaneously conduct vehicle service or inspection procedures on vehicles, each utilizing a dedicated vehicle-specific diagnostic software application residing in one of the virtual processing systems.

In a further embodiment, the database service storing installation packages for vehicle-specific diagnostic software applications is configured to receive updates, revisions, and new vehicle-specific diagnostic software applications from vehicle manufacturers, enabling service technicians utilizing the cloud-based or virtualized vehicle diagnostic application service to access current vehicle diagnostic software at all times.

The foregoing features, and advantages set forth in the present disclosure as well as presently preferred embodiments will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings. It is to be understood that the drawings are for illustrating the concepts set forth in the present disclosure and are not to scale.

Figure 1:
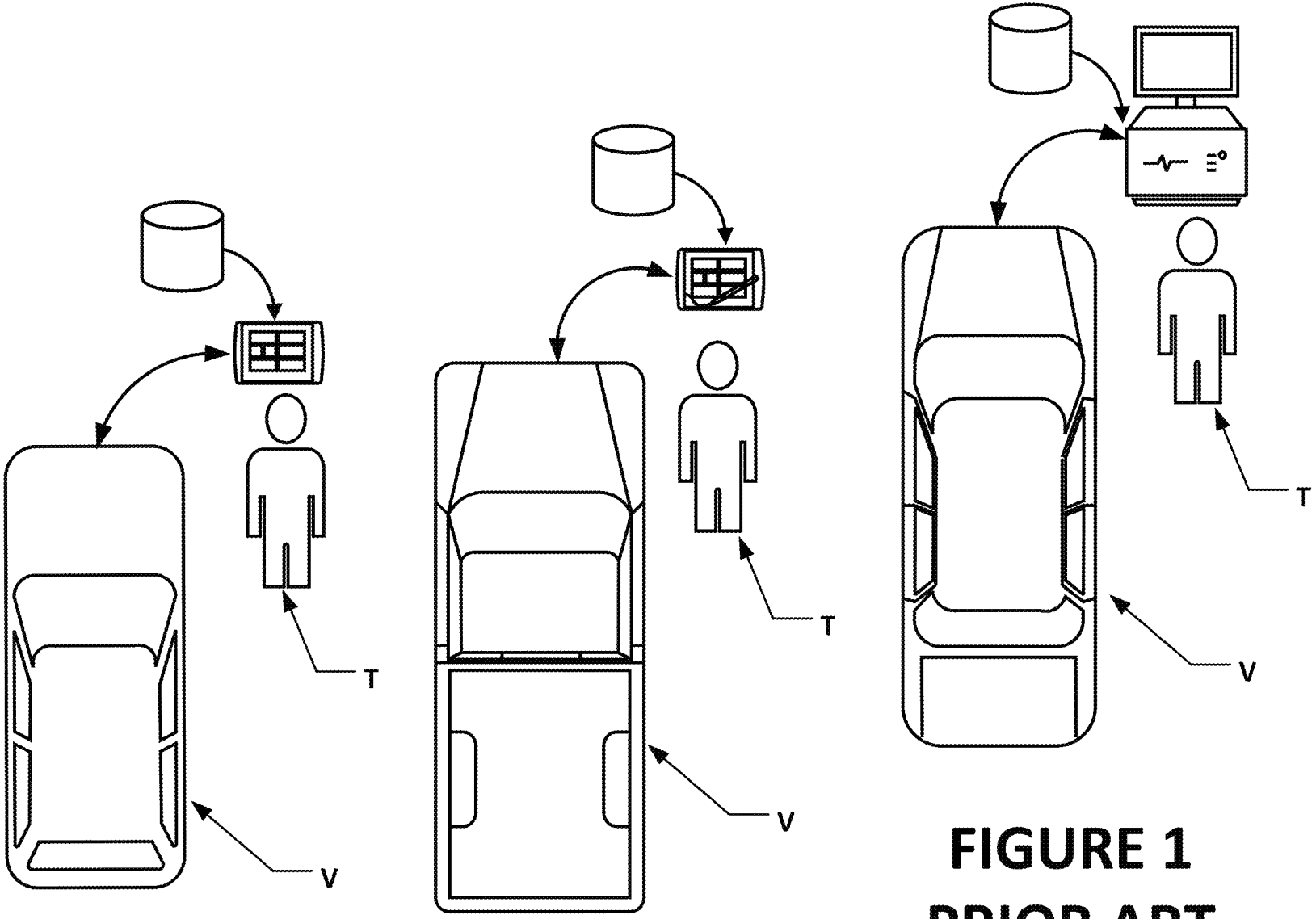
FIGURE 1 PRIOR ART
FIG. 1 is a prior art illustration of multiple vehicles undergoing service and/or inspection, each utilizing a dedicated diagnostic scan tool configured with a vehicle-specific software application.
Figure 2:
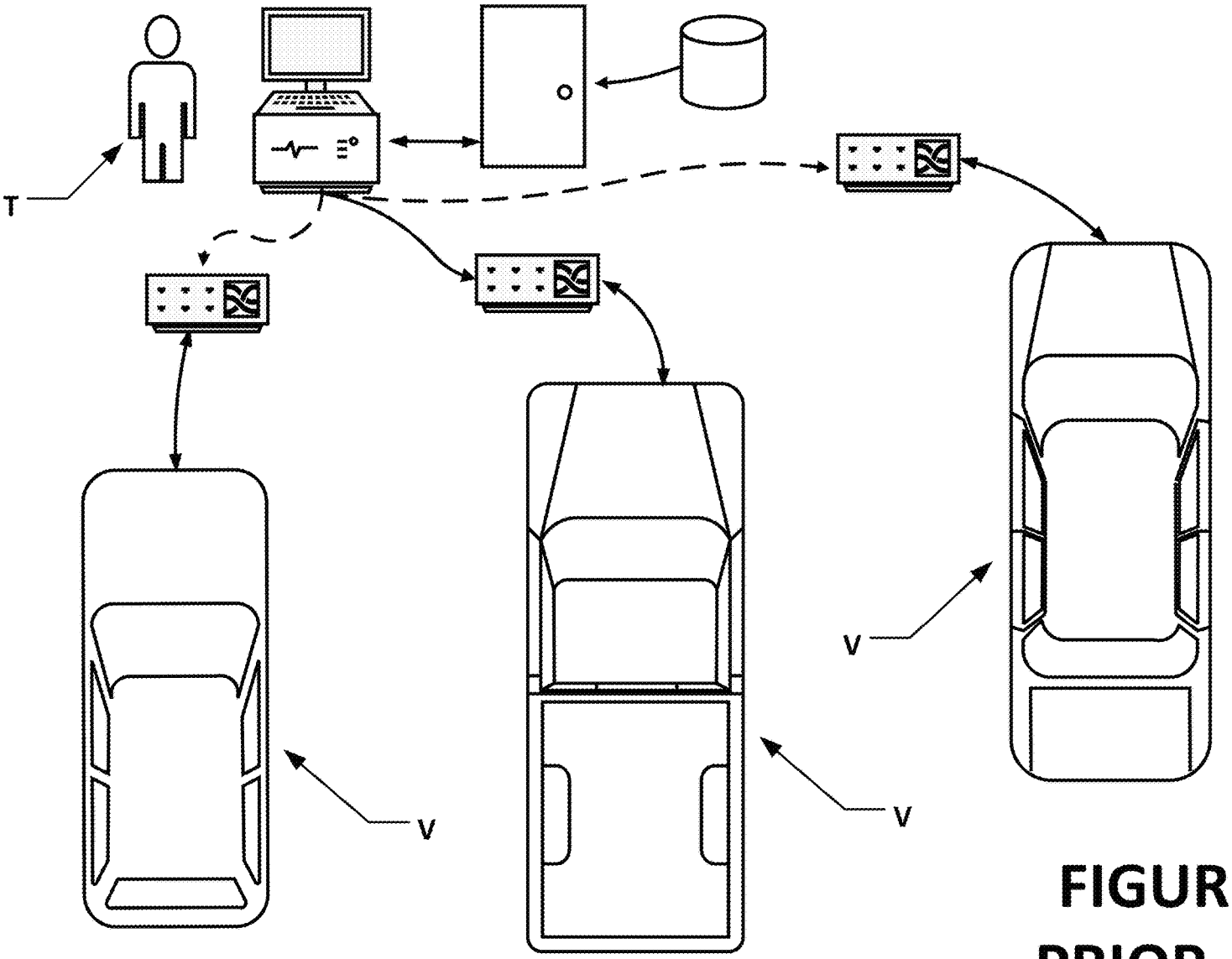
FIGURE 2 PRIOR ART
FIG. 2 is a prior art illustration of multiple vehicles undergoing service and/or inspection, each coupled in turn, via a standard interface to a single local processing system, which is configured with appropriate vehicle-specific diagnostic software retrieved from a software archive.

Before any embodiments of the invention are explained in detail, it is to be understood that the invention is not limited in its application to the details of construction and the arrangement of components set forth in the following description or illustrated in the drawings.

DETAILED DESCRIPTION

The following detailed description illustrates the invention by way of example and not by way of limitation. The description enables one skilled in the art to make and use the present disclosure, and describes several embodiments, adaptations, variations, alternatives, and uses of the present disclosure, including what is presently believed to be the best mode of carrying out the present disclosure.

Figure 3:
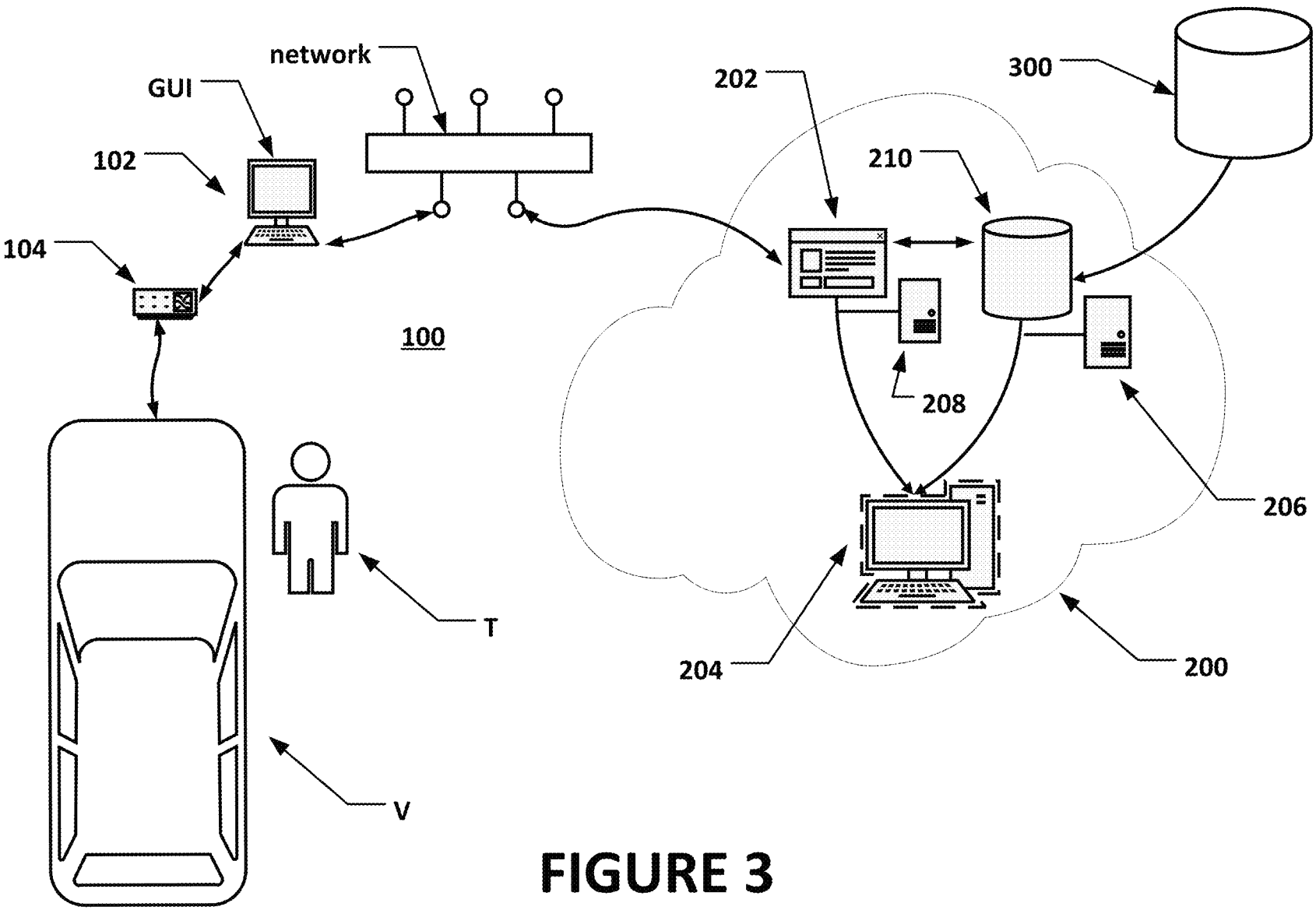
FIG. 3 is an illustration of a single vehicle undergoing service and/or inspection, utilizing a vehicle-specific diagnostic software application residing in a virtual processing system configured utilizing a cloud-based vehicle diagnostic application service and associated database.

Turning to the figures, and to FIG. 3 in particular, components of a vehicle service system for interaction with the on-board electronic systems of a wide range of vehicle makes and models are shown generally at 100. The vehicle service system utilizes a cloud-based or virtualized vehicle diagnostic system 200 which is configured on-demand in response to an identification of the make or model of a vehicle V undergoing a service procedure. Equipment requirements of the vehicle service system 100 are minimal. The vehicle service system 100 includes a local personal computer (PC) or end-user terminal 102 having conventional user interface components, such as a monitor or other physical means of displaying electronic graphic content (a graphical user interface GUI), human interface devices such as a keyboard and mouse, a network interface card (NIC) for connection to various networks, and a standardized communication interface 104. A typical vehicle service system 100 will be a vehicle wheel alignment measurement system and accompanying hardware components, but may consist of other types of vehicle service systems such as inspection or diagnostic systems having appropriate hardware and software components. The standardized communication interface 104 or transport bus provides an operative couple to a diagnostic connection onboard the vehicle V undergoing service. The standardized communication interface 104 provides a pathway for bi-directional communication between external devices and the various electronic control modules and sensors onboard the vehicle. An exemplary standardized communication interface is an SAE J2534 compliant device intended to be connected between a USB connection at the local processing system 102, such as a PC or end-user terminal, and an SAE J1962 (OBDII) connector coupling to a vehicle on-board communication pathway or electronic control module (ECU), enabling bi-directional communication between the vehicle systems and an application program interface (API) from the vehicle manufacturer.

The local processing system 102 is configured with an operating system and software instructions to provide a suitable graphical user interface GUI for a service technician. The local processing system 102 is further connected, via a suitable communications pathway such as a network interface card and the internet, to a remote cloud-based or virtualized vehicle diagnostic application service 202 configured to establish a session with a temporary virtual processing system 204 running a vehicle-specific diagnostic software application or vehicle manufacturer-specific API in response to a request from the service technician T input through the graphical user interface GUI. The software instructions installed at the local processing system 102 function as a broker between the local processing system 102 and the virtualization environment containing the virtualized vehicle diagnostic application service 202 and temporary virtual processing system 204. The software agent allows the local processing system 102 to view, control, and interact with the virtualization environments 202 and virtual processing system 204. The software agent may also pass data from a bus, like USB, to the remote virtual environment; this is commonly referred to as pass-through or USB pass-through.

The virtualization infrastructure 200 containing the virtualized vehicle diagnostic application service 202 and temporary virtual processing system 204 can be simple or complex, but the basic components will consist of:

1. a computer or set of computers (i.e., App Servers) 206 configured with software instruction to carry out required computations (CPU processing) for the application(s) a user wants to access;
2. a computer or set of computers 208 that will act as a gateway or connection broker (proxy) between the user terminal or local processing system 102 and the app servers, providing a layer of security (a virtual firewall) to restrict access to services to authorized users only, to prevent external attacks, and to ensure that App Servers are always available for use;
3. a computer or set of computers called an Application Delivery Controller (ADC), which may be the same device as the gateway 208, configured to make the entire operation effective over the Internet, to balance workloads between App Servers, to route communication traffic to the machine best equipment to handle the request, and to compress data—making its transport over the Internet more efficient. In many scenarios the gateway and ADC may be the same device 208; and
4. a computer or set of computers configured to function as a primary web interface, commonly referred to as an App Store, where an end-user would navigate, picking which apps or services they want to launch or initiate.

Virtualization environments operate in one of two basic types: Type I and Type II Hypervisors. A hypervisor is the low-level programming designed to run multiple operating systems on a single piece of hardware. A Type I Hypervisor, often called a bare-metal hypervisor, has no other operating system running the basic computing components. Citrix Xenserver or VMware ESXi are examples of Type I hypervisors. In one embodiment, the present application utilizes VMware ESXi (Type I Hypervisor) to run 250+ servers on a single piece of equipment. A Type II hypervisor is a hypervisor that runs on top of another operating system. An example of a Type II hypervisor would be a Macintosh® application that allows a user to run a Windows 10® OS concurrently in a separate window.

Upon activation, the vehicle-specific diagnostic software application or vehicle manufacturer-specific API operating on the virtual processing system 204 communicates with the vehicle V undergoing service, and the service technician T, through the communications pathway, the local processing system graphical user interface, and bi-directional pathways of the standardized communication interface 104. Options and diagnostic results available from the vehicle-specific diagnostic software application or vehicle manufacturer-specific API are presented to the service technician T within the graphical user interface GUI, enabling the service technician T to conduct a vehicle-specific diagnostic, inspection, or service procedure as if the vehicle-specific diagnostic software application or vehicle manufacturer-specific API was present on the local processing system 102. Upon completion of the vehicle service, the remote cloud-based vehicle diagnostic application service 202 terminates the temporary virtual processing system 204 and the resident vehicle-specific diagnostic software application or vehicle manufacturer-specific API, freeing cloud-based resources for subsequent uses.

In a further embodiment, the cloud-based vehicle diagnostic application service 202 is configured with software instructions for user authentication, access control, subscription services, and payment processing as required for regulating access to multiple vehicle-specific diagnostic software applications or vehicle manufacturer-specific APIs. Different vehicle manufacturers may limit access to their vehicle-specific diagnostic software applications using different practices. For example, some vehicle-specific diagnostic software applications may be limited to use by a service technician T in association with service or inspection of a single vehicle V. For subsequent vehicles, the service technician T is required to reinstall the software to ensure use of the most up to date version. Alternatively, some vehicle-specific diagnostic software applications are accessible to a service technician T via a time-based subscription, without restriction as to the number of vehicle services or inspections. Regardless of the specific access restrictions placed on the vehicle-specific diagnostic software applications by the vehicle manufacturer or software creator, the cloud-based vehicle diagnostic application service 202 is configured to provide the service technician T with a simplified common user authentication process across a wide variety of vehicle-specific diagnostic software applications. An initial setup procedure to provide appropriate credentials and/or payment information for subscription-based services is typically required, with the authorized user's information stored in a suitable database 210 accessible to the cloud-based vehicle diagnostic application service 202. Storing the user information enables appropriate user authentication and payment information to be recalled and utilized by the cloud-based vehicle diagnostic application service 202 as required in order to permit or maintain access to the individual vehicle-specific diagnostic software applications requested by approved users. Optionally, the cloud-based vehicle diagnostic application service 202 may be configured to automatically establish, maintain, and/or renew software subscriptions for authorized or approved users, as well as store multiple passwords, access credentials, and payment information, allowing users a single-point login for multiple individual vehicle-specific diagnostic software applications.

The vehicle diagnostic application service 202 further provides access to a database service or software archive 300 storing installation packages for vehicle-specific diagnostic software applications or vehicle manufacturer-specific APIs, each of which is associated with at least one specific vehicle make or model. These installation packages or "gold" or "master images" may be created in advance for each vehicle-specific diagnostic software application or vehicle manufacturer-specific API to be made available to end users.

In response to an authenticated or approved request from a service technician, the cloud-based vehicle diagnostic application service 202 locates and retrieves (or clones) an installation package for a vehicle-specific diagnostic software application or vehicle manufacturer-specific API within the database service or software archive 300 which corresponds with a vehicle on which the service technician is currently performing a service or inspection procedure. After establishing the temporary virtual processing system 204 within the cloud environment, the cloud-based vehicle diagnostic application service 202 is configured to utilize the installation package to install or launch the vehicle-specific diagnostic software application or manufacturer-specific API into the virtual processing system 204. With the vehicle-specific diagnostic software application installed on the virtual processing system 204, a user interface for the vehicle-specific diagnostic software application or manufacturer-specific API is presented to the service technician via the graphical user interface GUI on the local processing system 102. Bi-directional communications between the vehicle V and the vehicle-specific diagnostic software application or manufacturer-specific API are routed through the standardized communication interface 104, local processing system 102, and intervening communications links such as the internet to the virtual processing system 204, enabling the vehicle-specific diagnostic software application or manufacturer-specific API to conduct appropriate vehicle service or inspection procedures.

User sessions created in response to authenticated or approved requests from service technicians T can be persistent or non-persistent. In a persistent state, when a service technician T disconnects from a virtual application session, that session waits for the service technician T to reconnect. Session "A" will always be assigned to Technician "A", and no other service technician T can access that session. In a non-persistent state, once a service technician T disconnects from a virtual application session, the session resets, or returns to baseline. Technician A will be given the first available session, and if they disconnect to return later, they may or may not be assigned to the same session. Persistent sessions are more expensive to maintain, as a provider will always need n Ford sessions for n Ford customers. With non-persistent sessions, the virtualization system 202 can automatically manage active virtual application sessions based on workload. If only 30 of a provider's n customers are actively using the Ford application, then only 30 virtual application sessions will be created. Storage for user session data can be maintained in one of three ways:

1. Temporary virtual application session data is data only stored while a session is active. Once a virtual application session is terminated, then any associated data is lost.
2. Persistent virtual application session data is data only available to Customer "A" on Session "A."
3. Redirected virtual application session data is data that is retained, but in a separate location outside of the session. Data is stored in an accessible central repository for a service technician T, such as database 210, and that data is available to the service technician regardless of which virtual application session they launch. This is the least expensive method to reliably maintain service technician data, but as the volume of data grows, the time to import that data into a session increases, thus increases application launch times.

Figure 4:
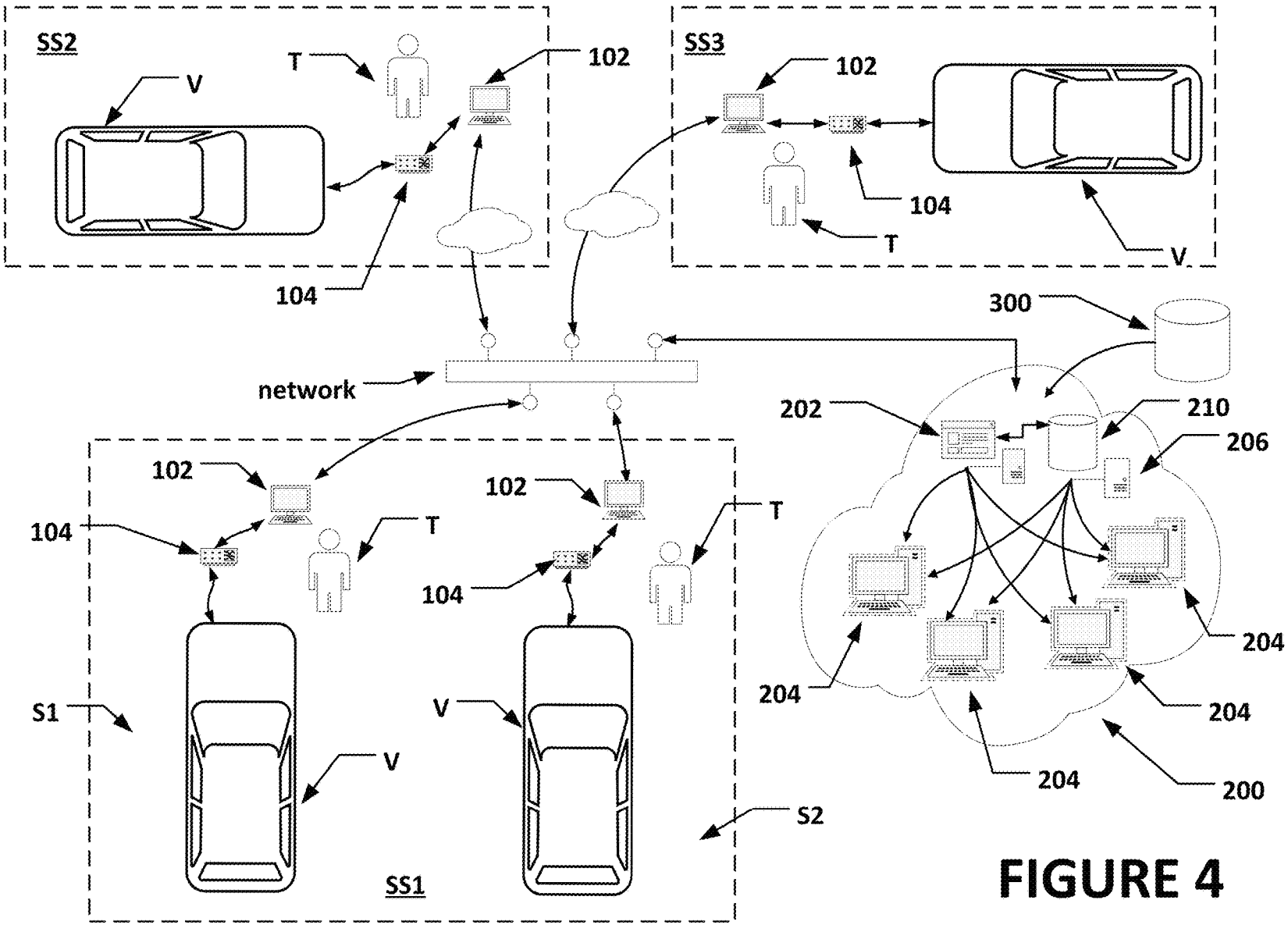
FIG. 4 is an illustration of multiple vehicles simultaneously undergoing service and/or inspection, utilizing vehicle-specific diagnostic software applications residing in virtual processing systems, each configured utilizing a cloud-based vehicle diagnostic application service and associated database.

In a further embodiment, illustrated in FIG. 4, the cloud-based vehicle diagnostic application service 200 is configured to establish multiple independent virtual processing systems 204 within the cloud or virtualization environment, enabling multiple service technicians at various physical locations, such as separate service bays S1, S2 within a single service shop SS1, or from separate service shops SS1, SS2, SS3, to simultaneously conduct vehicle service or inspection procedures on vehicles V of varying makes and manufacture, each utilizing a dedicated vehicle-specific diagnostic software application or manufacturer-specific API residing in one of the temporary virtual processing systems 204.

In a further embodiment, the database service or software archive 300 storing installation packages for vehicle-specific diagnostic software applications is configured to receive updates, revisions, and new vehicle-specific diagnostic software application or manufacturer-specific API from third party vendors and/or vehicle manufacturers, enabling service technicians utilizing the cloud-based vehicle diagnostic application service 200 to access to the most up-to-date vehicle diagnostic software at all times.

The present disclosure can be embodied in-part in the form of computer-implemented processes and apparatuses for practicing those processes. The present disclosure can also be embodied in-part in the form of computer program code containing instructions embodied in tangible media, or another computer readable non-transitory storage medium, wherein, when the computer program code is loaded into, and executed by, an electronic device such as a computer, micro-processor or logic circuit, the device becomes an apparatus for practicing the present disclosure.

The present disclosure can also be embodied in-part in the form of computer program code, for example, whether stored in a non-transitory storage medium, loaded into and/or executed by a computer, or transmitted over some transmission medium, wherein, when the computer program code is loaded into and executed by a computer, the computer becomes an apparatus for practicing the present disclosure. When implemented in a general-purpose microprocessor, the computer program code segments configure the microprocessor to create specific logic circuits.

As various changes could be made in the above constructions without departing from the scope of the disclosure, it is intended that all matter contained in the above description or shown in the accompanying drawings shall be interpreted as illustrative and not in a limiting sense.

The invention claimed is:

1. A vehicle service system for interaction with on-board electronic systems for a plurality of vehicle makes and models, comprising:

a local processing system configured with software instructions to provide a graphical user interface for use by a service technician during a vehicle diagnostic, service or inspection procedure;

a communication interface for operatively coupling said local processing system to a diagnostic connection onboard a vehicle undergoing service for bi-directional communication between said local processing system and at least one electronic control module onboard said vehicle;

a cloud-based vehicle diagnostic application service in communication with said local processing system via a communications pathway, said cloud-based virtualized vehicle diagnostic application service responsive to a request, from said local processing system, containing an identification of said vehicle undergoing service, to establish a virtual processing system configured with a vehicle-specific software application selected from a software archive; and wherein said established virtual processing system is in operative bi-directional communication with said local processing system and said at least one electronic control module onboard said vehicle via said communications pathway and said communication interface to carry out said vehicle diagnostic, service, or inspection procedure using said vehicle-specific software application.

2. The vehicle service system of claim 1, wherein said cloud-based vehicle diagnostic application service includes:

at least one processing system configured as an App Store;

at least one processing system configured as an App Server; and at least one processing system configured as an Application Delivery Controller.

3. The vehicle service system of claim 2, wherein said cloud-based vehicle diagnostic application service further includes a gateway configured as a connection broker (proxy) between said local processing system and said App Server.

4. The vehicle service system of claim 1, wherein said local processing system is a vehicle wheel alignment measurement and/or inspection system.

5. The vehicle service system of claim 1, wherein said established virtual processing system is configured to utilize said graphical user interface for bi-directional communication with said service technician during a vehicle diagnostic, service, or inspection procedure.

6. The vehicle service system of claim 1, wherein said established virtual processing system is terminated upon completion of said vehicle diagnostic, service, or inspection procedure.

7. The vehicle service system of claim 1, wherein said cloud-based vehicle diagnostic application service is configured with software instructions to perform a user authentication procedure prior to establishing said virtual processing system; and wherein said user authentication procedure verifies an authorization of said service technician to access said a vehicle-specific diagnostic software application.

8. The vehicle service system of claim 1, wherein said cloud-based vehicle diagnostic application service is configured with software instructions to maintain a database of authorized user accounts, said database of authorized user accounts including user identification data, user passwords, user payment information, and an identification of vehicle-specific diagnostic software applications accessible to each of said authorized user accounts.

9. The vehicle service system of claim 8, wherein said cloud-based vehicle diagnostic application service is configured with software instructions to utilize information stored within said database of authorized user accounts to provide payment services in association with access to, and/or subscriptions to, said accessible vehicle-specific diagnostic software applications for each authorized user account.

10. A method for providing vehicle-specific diagnostic software for a plurality of vehicles undergoing service or inspection, comprising:

for each vehicle, establishing a first bi-directional communication connection between an on-board data communications pathway and an associated local processing system having a graphical user interface;

for each associated local processing system, establishing a second bi-directional communication connection to a cloud-based vehicle diagnostic application service;

responsive to each established bi-directional communication connection to said cloud-based vehicle diagnostic application service, creating a virtual processing system configured with a vehicle-specific diagnostic software application associated with said vehicle undergoing service or inspection; and for each vehicle, conducting a vehicle service or inspection utilizing said vehicle-specific diagnostic software application residing in said virtual processing system, utilizing said graphical user interface of said associated local processing system and each of said first and second established bi-directional communication connections to establish a connection between said vehicle on-board data communications pathway and said virtual processing system for transfer of data and/or instructions between said virtual processing system and at least one electronic control module onboard said vehicle.

11. The method of claim 10, wherein each of said virtual processing systems is temporary, and is terminated upon completion of said associated vehicle service or inspection.

12. The method of claim 10 further including coordination of a payment transaction associated with utilization of said vehicle-specific diagnostic software application through said cloud-based vehicle diagnostic application service.

13. The method of claim 10, wherein creating said virtual processing system further includes identifying a vehicle associated with said local processing system in bi-directional communication with said cloud-based vehicle diagnostic application service, and retrieving from a software archive, for installation on said virtual processing system, a vehicle-specific diagnostic software application associated with said identified vehicle.

14. The method of claim 10 wherein establishing said second bi-directional communication connection to said cloud-based vehicle diagnostic application service includes:

verification of access credentials for an authorized user of said local processing system;

recalling, from an established user account associated with said authorized user, a list of vehicle-specific diagnostic software applications available to said authorized user; and selection, by said authorized user, of a vehicle-specific diagnostic software application from said list to configure said virtual processing system.

15. A method for conducting a vehicle service procedure, comprising:

retrieving, from a cloud-based vehicle diagnostic application service, a vehicle-specific diagnostic software package from an accessible software archive;

establishing a virtual processing system in operative communication with a vehicle undergoing said vehicle service procedure;

configuring said virtual processing system with said located vehicle-specific diagnostic software package; and establishing bi-directional communication between said virtual processing system and said vehicle to enable operation of said vehicle-specific diagnostic software package during said vehicle service procedure.

16. The method of claim 15 further including the step of terminating said virtual processing system and said established bi-directional communication upon completion of said vehicle service procedure.

17. The method of claim 15 further including the step of providing a graphical user interface to said virtual processing system for a service technician to interact with said vehicle-specific diagnostic software package through an internet-connected local processing system.

18. The method of claim 15 further including the step of verifying user authorization to utilize said vehicle-specific diagnostic software package prior to retrieving said vehicle-specific diagnostic software package from said accessible software archive.

19. A method for electronic communication with a vehicle undergoing a service or inspection procedure, comprising:

receiving, at a cloud-based vehicle diagnostic application service, a vehicle interface request generated by an internet-connected local processing system operatively coupled to said vehicle for bi-directional communication with at least one vehicle electronic control unit;

responsive to said received request, establishing within said cloud environment, a virtual processing system configured with a vehicle-specific diagnostic software application associated with said vehicle;

operating said vehicle-specific diagnostic software application in bi-directional communication with said vehicle electronic control unit during said vehicle service or inspection through said internet-connected local processing system, said bi-directional communication including at least a transmission of a data inquiry to said vehicle from said virtual processing system together with receipt at said virtual processing system of a response from said vehicle; and upon completion of said vehicle service or inspection, terminating said virtual processing system.

20. The method of claim 19, wherein said bi-directional communication further includes a transmission of at least one command from said virtual processing system to said at least one vehicle electronic control unit.

21. The method of claim 19, wherein operating said vehicle-specific diagnostic software application includes receiving input from a service technician via a graphical user interface of said internet-connected local processing system.

* * * * *